United States Patent [19]

Foster

[11] Patent Number: 4,804,181

[45] Date of Patent: Feb. 14, 1989

[54] SEMI-SPHERICAL GOLF CLUB GRIP STRUCTURE

[76] Inventor: Craig L. Foster, 1813 Mark St., N.E., Olympia, Wash. 98506

[21] Appl. No.: 97,697

[22] Filed: Sep. 17, 1987

[51] Int. Cl.[4] ..... A63B 53/14

[52] U.S. Cl. ..... 273/81 D; 273/165

[58] Field of Search ..... 273/81 R, 81 D, 81.2, 273/81.3, 81.4, 165, 166, 183 R, 183 D, 186 A

[56] References Cited

U.S. PATENT DOCUMENTS

| | | | |
|---|---|---|---|
| 715,225 | 12/1902 | Whitner | 273/165 |
| 1,573,612 | 2/1926 | Johnston | 273/81 D |
| 2,481,778 | 9/1949 | Pearson | 273/165 |
| 3,036,836 | 5/1962 | Mason | 273/165 |
| 3,084,938 | 4/1963 | Kapanowski | 273/81 D X |
| 3,368,811 | 2/1968 | Finney | 273/166 X |
| 4,052,059 | 10/1977 | Rigsby | 273/165 X |

OTHER PUBLICATIONS

Tommy Bolt, Golf World, Aug. 26, 1977, p. 25.

*Primary Examiner*—Carlton R. Croyle
*Assistant Examiner*—Eugene L. Szczecina, Jr.

[57] ABSTRACT

A golf training device in which there is a removable semi-spherical golf club grip structure, substantially in the shape of a golf ball, with a dimpled surfae, that can be attached to the grip of a golf club and held in the hand of the golfer in order to give the sensation of holding a golf ball in the hand while putting or chipping. The sensation of holding a golf ball with a dimpled surrafce, in the hand while putting or chipping allows the golfer to judge how much force is necessary to apply to the putting or chipping stroke in order to cause a golf ball to travel a desired specific distance to the hole. When this training device is removed from the golf club, the sensation of holding a golf ball in the hand remains, imparting greater sensation and increased skill to the golfer while putting and chipping.

1 Claim, 3 Drawing Sheets

SEMI-SPHERICAL GOLF CLUB GRIP STRUCTURE

BACKGROUND

1. Field of Invention

This invention relates to golf training aids and more particularly concerns a semi-spherical golf club grip structure which imparts a feeling of holding a dimpled golf ball while putting and chipping. The purpose is to develop skill in determining how much force to apply to the stroke causing a golf ball to travel a specific desired distance.

2. Description of Prior Art

Controlling the amount of force in a putting stroke and shots around the green is a skill highly desired by golfers. Heretofore, various golf club grip structures have been employed to provide increased control in the player's use of force during a golf stroke.

Prior art discloses two relevant types of grip structures. One type designed specifically to increase control by providing an enlarged handle to be held in the golfer's hand while executing a stroke. A second type increases control indirectly to its main purpose of providing a firm non-slipping grip, by attaching a knob structure that contacts the golfer's hand.

It has long been taught in golfing instruction that a golf stroke is similar to an underhand toss or roll of a golf ball. Prior art does not disclose a device that would allow the golfer to hold a dimpled golf ball in the hands while executing a golf stroke. Existing grip structures, because of their inability to transmit the feeling of holding a dimpled golf ball while making a stroke, fail to take full advantage of the golfer's highly sensitive hands. Because the putting and chipping stroke is closely related to rolling a golf ball with the hands, an enlarged grip structure in the form of a dimpled golf ball would provide for the most control of the power put into a golfing stroke.

While the U.S. Pat. No. 715,225 to Whitner, Dec. 2, 1902, teaches the use of a knob on the golf club that would create a sensation of holding a ball during the stroke, it does not teach the use of the distinctive dimpled surface of a golf ball on the handle of a golf club. The dimpled surface is significant because golfers are accustomed to holding a golf ball in their hand. When a golfer holds the dimpled surface and feels the weight or heft of a golf ball, he or she gains information about the golf ball through the sensitive hands. Information adding judgement for how much force necessary to roll the golf ball a specific desired distance is thus obtained directly from contact with the dimpled surface. A knob of any other type than a dimpled golf ball will transmit less accurate information to the golfer regarding control of the golf stroke.

The dated nature of Whitner weighs against its foreseeability of modern advances in golf ball construction that have made the present invention more easily accomplished.

Until recently, golf balls were generally constructed with an inner wrapping of banded rubber. Banded rubber does not allow a golf ball to retain its shape if it were cut to allow attachment to the golf shaft. Thus, the combination of golf ball and golf shaft was not easily accomplished at the time of Whitner and for many years thereafter. Golf ball construction of a solid core with an outer dimpled surface has become the most popular type of golf ball. Moden golf balls may be through bored while retaining their spherical conformity.

A further limitation to Whitner, illustrating a failure to recognize the problem solved by the present invention, is found in the text of U.S. Pat. No. 715,225. Whitner states the shaft knob for the right hand should be "entirely omitted" from the shaft when putting on the green. The vast majority of golfers are more coordinated in their right hand, thus creating the desirability for a device to heighten the sensitivity of the right hand during the putting stroke. Whitner teaches heightened sensitivity for putting by removing the grip knob from the shaft and extending the thumb and index finger down the shaft. Thus, connection of the golfer's most coordinated hand and the dimpled surface of the golf ball grip structure ended at a most critical stage.

The fact that Whitner fails to include details of a dimpled surface on the grip knob has a significant limiting consequence regarding the ability of his knob to give the sensation of holding a golf ball. Dimples were used on golf balls at the time of Whitner but were not included in any of the teachings of U.S. Pat. No. 715,225. The failure of Whitner to include use of a dimpled surface of a golf ball and a golf club places the present invention beyond the scope of Whitner.

Although Whitner allows for an inherent sensation of holding a ball while stroking, the present invention's inclusion of a dimpled surface results in a previously unappreciated advantage in creating the feeling of holding a golf ball in the hand.

The fact that golf balls at the time of Whitner contained dimples and yet were not included in his teaching points out the unobvious nature of the present invention. The concern of Whitner was a "firm" grip. The indented nature of a dimpled surface would be ineffectual for his purpose, thus unnecessary for inclusion within the scope of U.S. Pat. No. 715,225 to Whitner.

Relevant prior art to the present invention is found in U.S. Pat. No. 2,481,778 to Pearson, Sept. 13, 1949. Pearson teaches an enlarged paddle type grip attachment to be held in the hand while making a stroke. The disadvantage of this grip attachment stems from its dissimilarity to the dimpled surface of a golf ball. Holding a paddle in the hand while making a stroke gives the golfer little clue as to how much force would be required to make a golf ball travel a desired specific distance. Pearson is merely the equivalent of an oversized golf club grip, thus limiting its ability to create the sensation of rolling a golf ball with the hand.

The adjustable knob found in U.S. Pat. No. 4,052,059 to Rigsby, Oct. 4, 1977, likewise fails to include any detailed resemblance to a golf ball thus significantly limiting is ability to create the sensation of holding a golf ball while stroking.

A hand grip for golf clubs is found in U.S. Pat. No. 1,573,612 to Johnston, Feb, 16, 1926. Johnston teaches proper alignment and non-slipping of the hands by use of projections or eccentric parts on the grip. The failure of Johnston to teach the sensation of holding a ball when stroking is a result of the lack of spheroid shape to his grip. Johnston's grip is generally cylindrical and thus inapposite to the form of a sphere. Johnston, therefore, does not inherently create the sensation of holding a golf ball in the hand.

Prior art found in Golf World, Aug. 26, 1977: and U.S. Pat. 3,036,836 to Mason, May 29, 1962 also suffer from a failure to create the sensation of holding a golf ball while stroking. Mason is a grip locator to improve hand positioning, and Golf World is a finger conforming device which provides a firm grip but no sensation of holding a golf ball.

Golfers, therefore, would find it desirable to have a device which would increase skill and develop control of the amount of force in a golf stroke.

OBJECTS AND ADVANTAGES

Accordingly, I claim the following as objects and advantages of the invention; to provide an article of manufacture which faithfully and accurately produces the sensation of rolling or tossing a dimpled golf ball with the hand while the golfer strokes a ball with a golf club, to provide such an article of manufacture to increase golfing skill that is easily attached and detached from any desired golf club, to provide such a golf training device that produces by muscle memory the sensation of holding a dimpled golf ball in the hand while stroking after such training device is removed from the golf club, to provide a golf training device to increase skill in longer shots of up to 100 yards by allowing the golfer to feel the required force of stroke necessary to throw a golf ball such a desired distance when stroking a ball, to provide a golf training device small enough to be easily transported in a pocket, to provide a golf training aid with no loose parts that could become detached and lost, to provide a golf training aid impervious to wear and useable for a lifetime.

Another objective of this invention is to be inexpensive and easy to build, requiring only common tools and methods to manufacture.

Readers will find further objects and advantages of the invention from a consideration of the ensuing description and the accompanying drawings.

BRIEF DESCRIPTION OF THE DRAWINGS

Referring to the drawings.

DESCRIPTION OF THE PREFERRED EMBODIMENT

Figure 1:
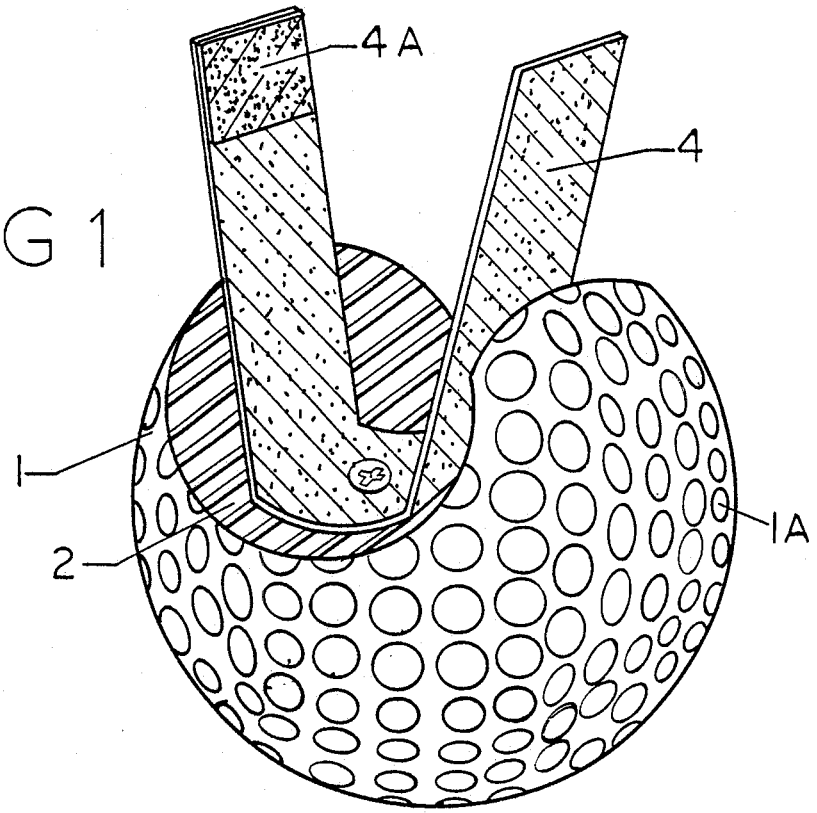
FIG. 1 is an illustration in perspective of a semi-spherical golf club grip structure 1, in accorance with the present invention.

Referring to FIG. 1, the example of one structure in accordance with the present invention shown includes a semi-spherical golf club grip structure 1, where the outer surface of said semi-spherical grip structure 1 contains symmetrically placed circular indentations 1A for the purpose of giving the semi-spherical golf club grip structure 1 the appearance and texture of a golf ball.

The raw material for structure 1 can consist of a spherically symmetrical golf ball with a diameter of approximately 1.680 inches or (42.67 mm), and a weight of approximately 1.620 ounces avoidupois or (45.93 grams).

The semi-spherical golf club grip structure 1, consisting of plastic material throughout in preference to an equivalent golf ball shaped structure comprised of an inner core of wound rubber bands with solid plastic material as an outer shell. The plastic material of the the semi-spherical golf club grip structure 1 allows an aperture 2 to be formed in said plastic material.

Figure 3:
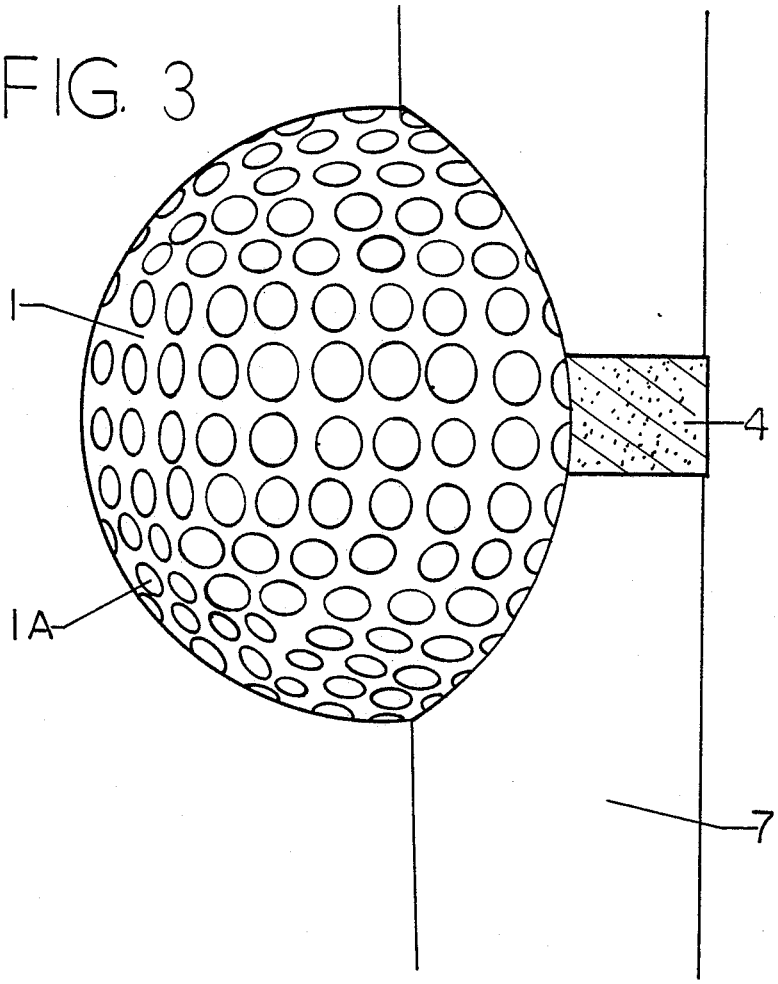
FIG. 3 is a plain view of the semi-spherical golf club grip structure 1 attached to a club 7.

Aperture 2 is a cylindrical aperture passing from one hemisphere to an opposite hemisphere of the semi-spherical golf club grip structure 1. The diameter of the cylindrical aperture 2 is approximately 1 inch. Aperture 2 in the semi-spherical golf club grip structure 1 is a means to allow unitized positioning of the semi-spherical golf club grip structure 1 onto golf club 7 as shown in FIG. 3.

Figure 2:
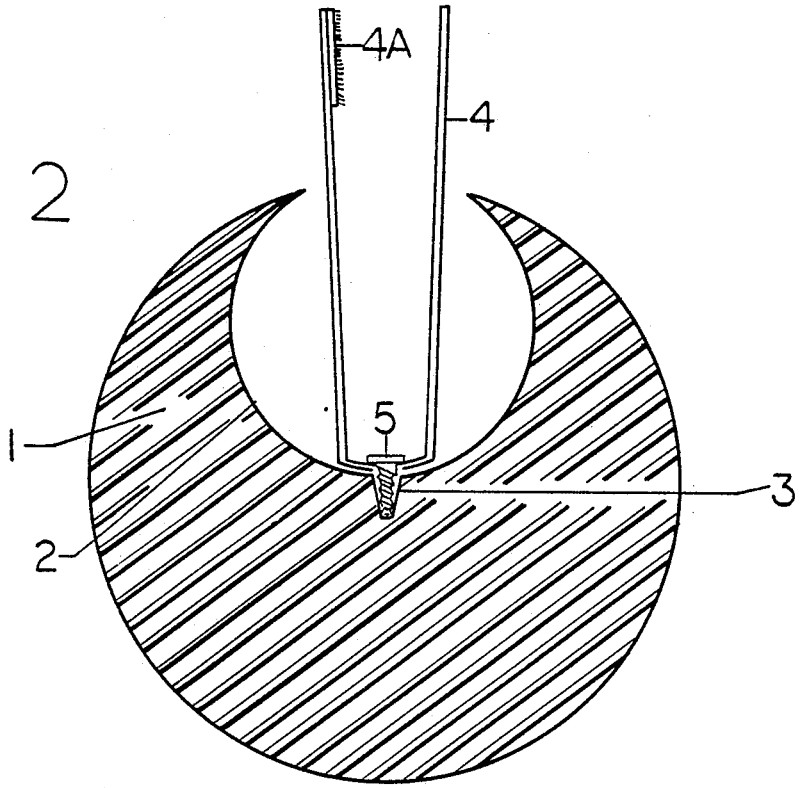
FIG. 2 is a cross-sectional view of the semi-spherical golf club grip structure 1.
Figure 4:
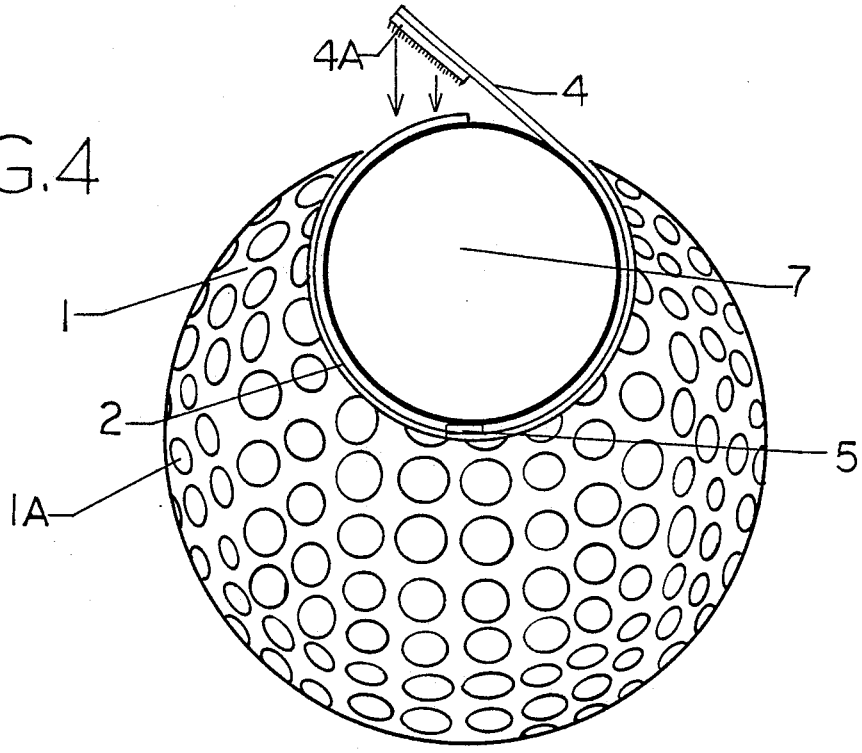
FIG. 4 is a plain view of the semi-spherical golf club grip structure 1 positioned on a golf club 7, and the method for attaching the adjustable connecting member 4 with the adjustor means 4A.

FIG. 1 illustrates adjustable connecting members 4 and 4A as a means for positioning the semi-spherical golf club grip structure 1 onto golf club 7 as shown in FIG. 4. The adjustable connecting member 4 is attached to the semi-spherical golf club grip structure 1 by fastening member 5 as illustrated in FIG. 2. Adjustable connecting member 4 can consist of a standard Velcro loop material where the loop is positioned against the outer surface of aperture 2 as illustrated in FIG. 2.

FIG. 2 illustrates adjustor means 4A that consist of standard Velcro hook material where the hook is positioned to the opposite surface of member 4 than the loop material of member 4 is positioned.

Referring to FIG. 2, the example of opening 3 in the material of the semi-spherical golf club grip structure 1, to provide means to connect the adjustable connecting member 4 with the semi-spherical golf club grip structure 1, by means of fastening member 5.

Referring to FIG. 3, one example of unitized positioning of the semi-spherical golf club grip structure 1 with a golf club 7, whereby the aperture 2 in the semi-spherical golf club grip structure surrounds the outer surface of golf club 7, and the adjustable connecting member 4 wraps around the outer surface of golf club 7 as a means to attach the semi-spherical golf club grip structure to golf club 7.

Referring to FIG. 4, the adjustable connecting member 4 and adjustor means 4A wrap around the outer surface of golf club 7 to provide a frictional adhearance as a means to attach the semi-spherical golf club strip structure 1 to golf club 7.

FIG. 4 illustrates the hook surface of the adjustor means 4A as it connects to the loop surface of the adjustable connecting member 4.

The need to adjust the adjustable connecting member 4 caused by various circumference sizes of golf club 7 is accomplished by pressing adjustor means 4A to any point on the loop surface of adjustable connecting member 4 thus providing sufficient friction to develop between adjustable connecting member 4 and golf club 7 that will hold the semi-spherical golf club grip structure 1 at a desired point on golf club 7.

Figure 5:
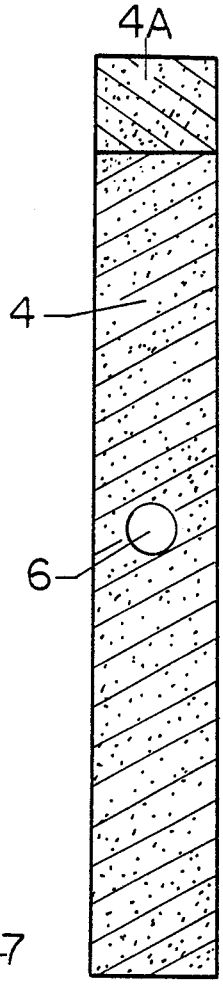
FIG. 5 is a plain view of the adjustable connecting member 4 showing an opening 6 permitting the fastening member 5 to pass through the adjustable connecting member 4 and into the opening 3 in the semi-spherical golf club grip structure 1.

Referring to FIG. 5, an opening 6 in the material of the adjustable connecting member 4 can be used as a means to allow a portion of fastening member 5 to pass through said connecting member 4 and into opening 3 of the material in the semi-spherical golf club grip structure 1 as a means to join the adjustable connecting member 4 to the semi-spherical golf club grip structure 1.

Figure 6:
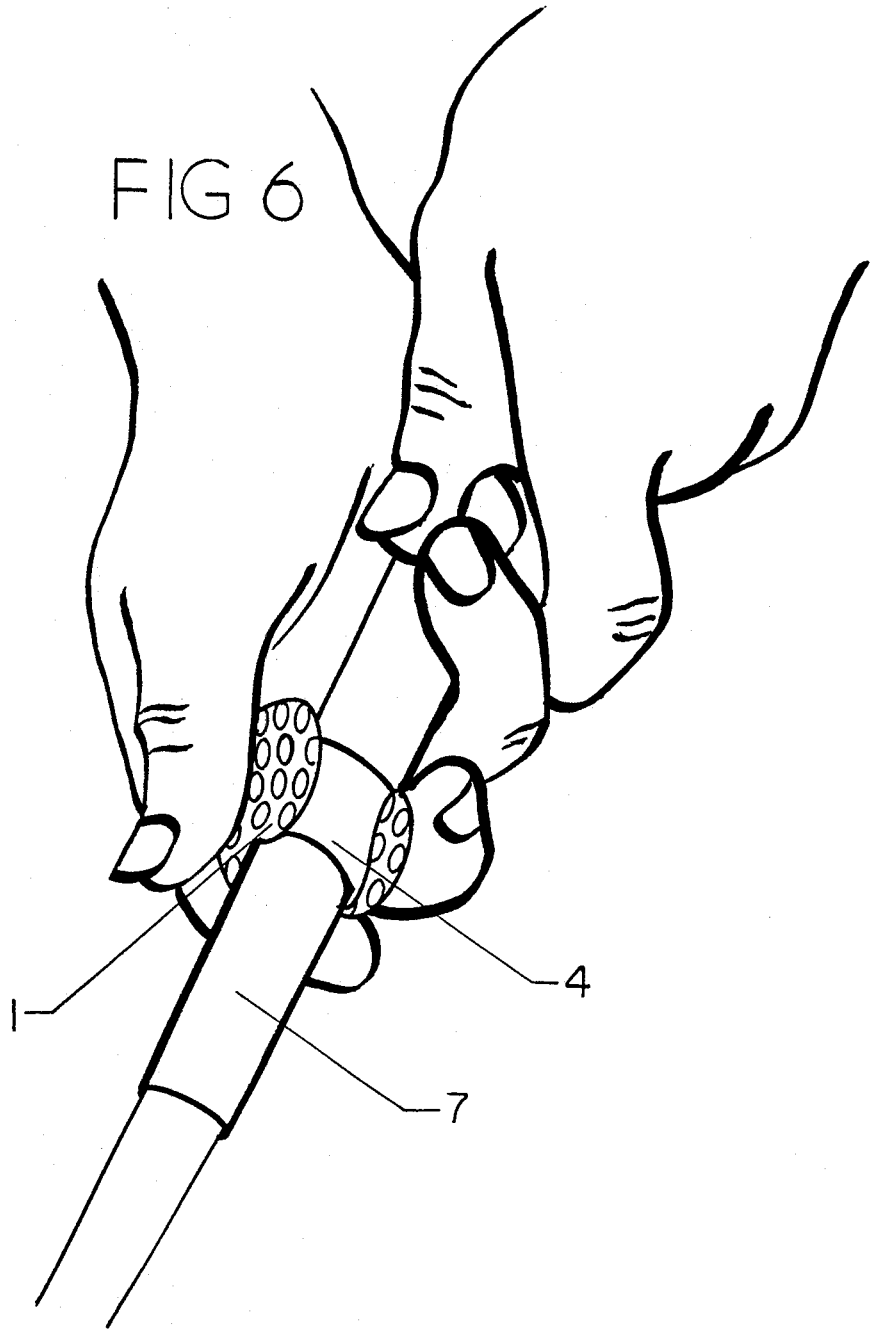
FIG. 6 illustrates a possible manner of holding the semi-spherical golf club grip structure 1 in the hand when putting or chipping.

FIG. 6 illustrates one method of use of the semi-spherical golf club grip structure 1 that has been connected to golf club 7, providing the sensation of holding a golf ball in the hand while executing a golf stroke. The feeling transmitted by the sensation of holding a golf ball is for the purpose of judging how much force to apply to the golf stroke to make a golf ball travel a desired specific distance to a hole in the putting green.

Although one detailed embodiment of the invention is illustrated in the drawings and previously described in detail, this invention contemplates any configuration and design of components which will accomplish the equivalent result. As an example, the invention can be manufactured as an integral part of the handle of a golf club.

As another example, the invention can be manufactured and marketed as a separate unit, which can be attached to a golf club.

I claim:

1. An improved golf club training structure, comprising a semi-spherical golf club grip knob for attachment to a golf club shaft, said knob having symmetrically placed circular identification known as dimples, thereover, as a means to transmit to a golfer, the sensation of holding a golf ball in the hand while executing a golf stroke and means connected to said knob for attaching said knob to a golf club shaft.

* * * * *